US005742008A

United States Patent [19]

Dalrymple

[11] Patent Number: 5,742,008

[45] Date of Patent: Apr. 21, 1998

[54] ARMORED CABLE

[75] Inventor: Larry V. Dalrymple, Claremore, Okla.

[73] Assignee: Baker Hughes Incorporated, Houston, Tex.

[21] Appl. No.: 563,712

[22] Filed: Nov. 28, 1995

[51] Int. Cl.[6] ..... H01B 7/18

[52] U.S. Cl. ..... 174/99 R; 174/103

[58] Field of Search ..... 174/102 R, 103, 174/68.1, 99 B, 99 E; 267/70, 71

[56] References Cited

U.S. PATENT DOCUMENTS

| | | | |
|---|---|---|---|
| 2,745,071 | 5/1956 | Miller et al. | 333/256 |
| 3,095,469 | 6/1963 | Cataldo | 174/88 B |
| 3,124,642 | 3/1964 | Meacham | 174/88 B |
| 3,654,378 | 4/1972 | Rehder | 174/99 B |
| 4,214,805 | 7/1980 | Faulconer | 339/198 G |
| 4,284,841 | 8/1981 | Tijunelis et al. | 174/103 |
| 4,415,762 | 11/1983 | Ponder | 174/99 B |
| 4,515,993 | 5/1985 | MacKenzie | 174/102 R |
| 4,600,805 | 7/1986 | Glynn et al. | 174/102 R |
| 4,707,568 | 11/1987 | Hoffman et al. | 174/103 |
| 5,414,217 | 5/1995 | Neuroth et al. | 174/120 R |

*Primary Examiner*—Kristine L. Kincaid
*Assistant Examiner*—Marc D. Machtinger
*Attorney, Agent, or Firm*—James E. Bradley

[57] ABSTRACT

A multi-conductor parallel array armored electrical power cable includes a pair of longitudinal spring members. The longitudinal spring members help maintain compactness between conductor assemblies within the power cable after a protective armor has been applied. The longitudinal spring members are installed between the outer most conductors and the armor of the cable. The unique shape of the spring members along with their placement during assembly absorb much larger tangential forces normally accepted when applying the armor to the cable. The spring members become distorted from their original shape and, as the armored cable is further formed to its final shape, the longitudinal spring members substantially return to their original shape to urge the conductor assemblies together.

22 Claims, 2 Drawing Sheets

ARMORED CABLE

BACKGROUND OF THE INVENTION

1. Field of the Invention

The present invention relates generally to electrical cables and, more particularly, to electrical cables having armor cladding. More particularly still, the present invention is related to an armor-clad electrical cable having improved resistance to swelling during decompression, and improved mechanical protection.

2. Description of the Prior Art

Electrical cables are well-known in the art. Especially well-known are prior art oil cables that have been designed for use in corrosive, high temperature and high pressure conditions. A typical prior art armor-cladded electrical cable for use in an oil well bore hole is illustrated in FIGS. 1 and 2. In FIG. 1, cable 10 includes at least three (3) conductor elements 12, which are arrayed in parallel to form power cable 10. Each conductor 12 further comprises a conductor 16, which is typically made of a highly conductive metal such as, for example, copper. Conductor 16 is covered with an insulation barrier 18, which is typically extruded onto conductor 16. Additionally, a lead barrier 20 is formed over the insulation barrier 18, thus completing conductor 12. The three (3) conductor cables are then aligned substantially parallel and then sealed with an armor layer 22.

At the point of assembly shown in FIG. 1, armor 22 has been applied to cable 10. At this stage, cable 10 proceeds through rollers to flatten the bow typically exhibited by armor 22. Unfortunately, the flattening stage causes the sides of cable 10 to expand or bow thus forming spaces 24. Spaces 24 can also occur between conductors 12. This results in a finished product that is somewhat loose and is undesirable both from a cosmetics viewpoint as well as with respect to decompression containment.

Accordingly, what is needed is an armored electrical cable that overcomes the problems of the prior art.

SUMMARY OF THE INVENTION

According to the present invention, a multi-conductor parallel array armored electrical power cable is disclosed. The power cable is unique in that it includes a pair of longitudinal spring members. The longitudinal spring members help maintain compactness between conductor assemblies within the power cable after a protective armor has been applied. The longitudinal spring members are installed between the outermost conductors and the armor of the cable. The unique shape of the spring members along with their placement during assembly absorbs much larger tangential forces normally accepted when applying the armor to the cable. The spring members become distorted from their original shape and, as the armored cable is further formed to its final shape, the longitudinal spring members substantially return to their original shape to urge the conductor assemblies together.

Further, a method of forming the electrical cable is also claimed. The cable is assembled by forming insulated center, first outer, and second outer conductors and placing the first outer conductor adjacent the center conductor and the second outer conductor adjacent the center conductor opposite the first outer conductor. This forms a parallel array of conductors. Next, a first longitudinal spring member is placed adjacent an outside edge of the first outer conductor and a second longitudinal spring member is placed adjacent an outside edge of the second outer conductor. The conductors and spring members are then wrapped with an outer armor layer, such that the application of the armor layer flexes the pair of spring members thereby urging the outer conductors toward the center conductor. Lastly, the armor layer is flattened against the parallel array of conductors to allow the spring members to return substantially to their original form, thereby urging the conductors together.

Each conductor is formed by extruding a center copper conductor element, insulating the center copper conductor element with an insulated layer, and then shielding the insulated layer with a lead sheath.

DETAILED DESCRIPTION OF THE INVENTION

Figure 1:
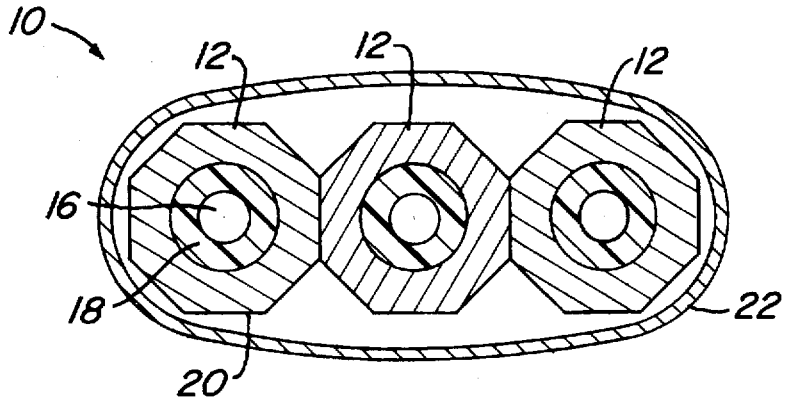
Fig. 1 (PRIOR ART)
FIG. 1 is a cross-sectional drawing of a prior art electric cable just after the armor layer has been applied.
Figure 2:
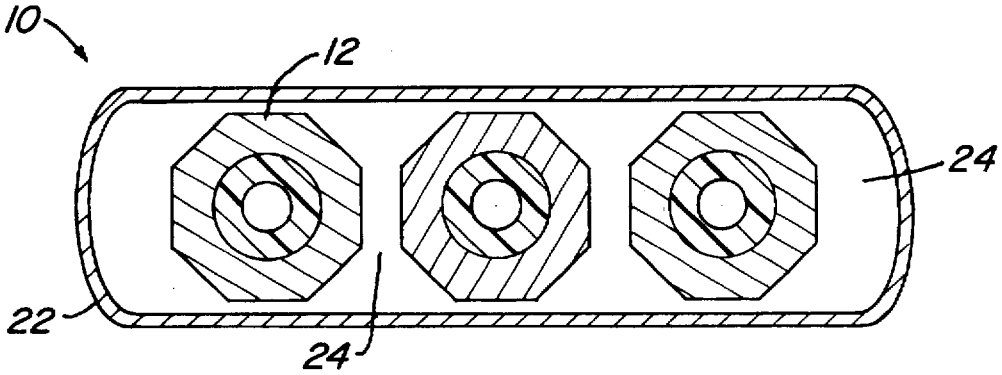
Fig. 2 (PRIOR ART)
FIG. 2 is a cross-sectional drawing of the cable in FIG. 1 after final forming.
Figure 3:
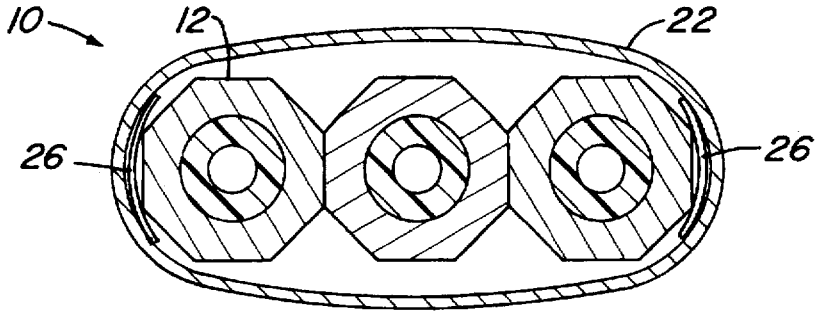
FIG. 3 is a cross-sectional drawing of an electric cable according to the present invention before final forming.

FIG. 3 is a cross-sectional illustration of a cable constructed according to the present invention. The cable 10 comprises at least three conductors 12, each having a main conductive strand 16, preferably made of copper. Strand 16 is covered with an insulative material or insulative layer 18. Resistive material 18 is a relatively thin continuous layer of a high temperature, high electric resistivity plastic. Next, conductor 12 is further covered with a lead sheath 20. Lead sheath 20 is extruded about insulative barrier 18 to protect further the copper conductor.

FIG. 3 further illustrates the preferred embodiment where conductors 12 are shaped octagonally so that flat surfaces may abut each other during assembly. Conductor 12, however, can be of a different configuration without departing from the spirit of the invention. For example, conductor 12 can be substantially round, oval, square, or polygonal.

Figure 4:
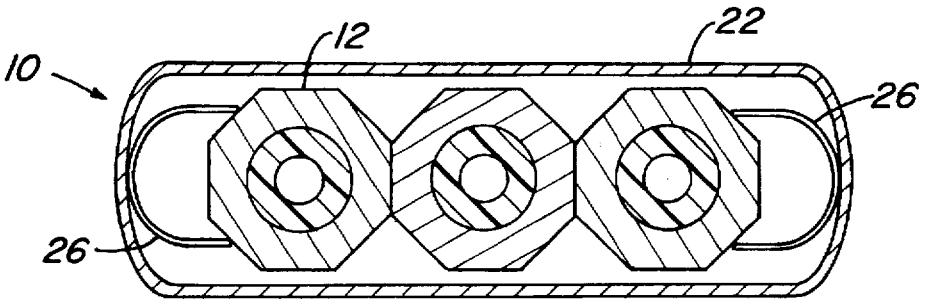
FIG. 4 is a cross-sectional drawing of the cable of FIG. 3 according to the present invention after final forming.

Once conductors 12 are ready for wrapping, a pair of longitudinal spring members 26, are placed on either side of the outer most conductors 12. Each longitudinal spring member 26 is substantially "C" shaped. Both spring members 26 are flattened in the application of armor 22 prior to the final forming. In FIG. 4, the flattening of spring members 26 is clearly evident. Each spring member 26 further urges conductors 12 towards the center conductor.

After armor layer 22 is wrapped around conductors 12, cable 10 goes through its final forming as illustrated in FIG. 4. Once the final forming stage has been completed, armor layer 22 is flattened on the tops and bottoms of conductors 12 while spring members 26 continue to urge conductors 12 against one another without them separating or filling the voids typically occurring on either side edge of cable 10.

Spring members 26 allow cable 10 to maintain its compactness between conductor assemblies within the protective armor of the parallel array power cable. With the longitudinal spring members 26 being installed between the outermost conductors 12 and the armor 22 of the cable, their unique shape and placement allow the cable to absorb tangential forces exerted during the initial application of the armor. The spring members 26 are distorted from their original shape, but then return to their original shape as the armored cable is further formed to its desired shape in subsequent processes. It is the returning to form of spring members 26 that maintains the compactness among the components within the armor 22.

Before the addition of spring members 26, armor 22 could only be applied up to a certain force before the parallel array of conductors 12 would be deformed, thus distorting the flat requirement of the parallel cable. With the addition of spring members 26, which disperse a greater amount of tangential force than before, armor 22 can be wrapped with greater force, thus resulting in a more compact and secure cable. This also allows the use of thicker, more rigid armor materials that will yield more robust cable. The greater force also withstands swelling during decompression stages to which the cable will be subjected. Further, spring members 26 also urge conductors 12 against one another, thus aiding in resisting swelling during decompression.

Spring member 26 has a curvature radius smaller than that of conductor 12 after the final lead shield 20 has been applied. Also, the ends of spring member 26 are closer together than the width or diameter of conductor 12.

Figure 5:
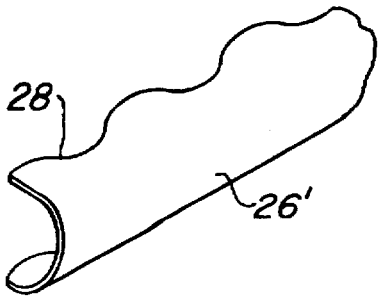
FIG. 5 is a perspective view of spring section for use with the cable of FIG. 3 with corrugated edges.
Figure 6:
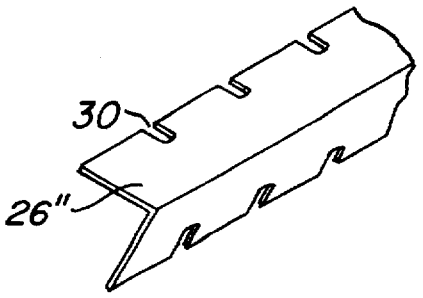
FIG. 6 is a perspective view of a spring section with notched edges and V-shape for use with the cable of FIG. 3.

The spring members could assume different forms in order to take advantage of performance and economic benefits inherent in variations of this concept. For example, the spring members 26 can be corrugated with corrugations 28 as depicted in FIG. 5. Alternately spring member 26" may include notches 30 to enhance bending of the finished cable shown in FIG. 6, or both. Also, the spring members 26" can also be V-shaped (FIG. 6).

While the invention has been shown in only one of its forms, it should be apparent to those skilled in the art that it is not so limited, but is susceptible to various changes without departing from the scope of the invention.

I claim:

1. An electrical cable for use in oil and gas wells, comprising:

an insulated center conductor;

an insulated first outer conductor adjacent said center conductor;

an insulated second outer conductor adjacent said center conductor and opposite said first outer conductor, forming a parallel array of conductors in a flat cable configuration;

a pair of longitudinal spring members, one adjacent an outside edge of each of said outer conductors; and an outer armor layer wrapped around and in contact with said conductors and said spring members, such that the wrapping of said armor layer flexes said pair of spring members thereby urging said outer conductors toward said center conductor, and wherein after the flattening of said armor layer against said parallel array of conductors, said spring members substantially return to their original form, thereby urging said conductors together, maintaining their parallel array.

2. The electrical cable according to claim 1 wherein each of said conductors further comprises:

a center copper conductor element;

an insulated layer about said center copper conductor element; and a lead sheath about said insulated layer.

3. The electrical cable of claim 1 wherein each of said conductors has a substantially octagonal exterior shape.

4. The electrical cable of claim 1 wherein said spring members have two edges which include regularly spaced notches along each edge.

5. The electrical cable of claim 1 wherein each of said spring members is a semi-circular member having a smaller radius than a radius of each of said conductors.

6. The electrical cable of claim 1 wherein said spring members have corrugated edges.

7. The electrical cable of claim 1 wherein each of said spring members further includes a first and second edge running substantially parallel to one another and wherein each of said first and second edges touches the outside edge of each of a corresponding one of said outer conductors.

8. An electrical cable for use in oil and gas wells, comprising:

an insulated center conductor;

an insulated first outer conductor adjacent said center conductor;

an insulated second outer conductor adjacent said center conductor and opposite said first outer conductor, forming a parallel array of conductors in a flat cable configuration;

a pair of longitudinal substantially C-shaped spring members, one adjacent an outside edge of each of said outer conductors; and an outer armor layer wrapped around and in contact with said conductors and said spring members, such that the wrapping of said armor layer flexes said pair of spring members thereby urging said outer conductors toward said center conductor, and wherein after the flattening of said armor layer against said parallel array of conductors, said spring members substantially return to their original form, thereby urging said conductors together, maintaining their parallel array.

9. The electrical cable according to claim 8 wherein each of said conductors further comprises:

a center copper conductor element;

an insulated layer about said center copper conductor element; and a lead sheath about said insulated layer.

10. The electrical cable of claim 8 wherein each of said conductors has a substantially octagonal exterior shape.

11. The electrical cable of claim 8 wherein said spring members include two edges having notches along each edge.

12. The electrical cable of claim 8 wherein said spring members have a smaller radius than a radius of said conductors.

13. The electrical cable of claim 8 wherein said spring members have corrugated edges.

14. The electrical cable of claim 8 wherein each of said spring members further includes a first and second edge running substantially parallel to one another and wherein each of said first and second edges touches the outside edge of each of a corresponding one of said outer conductors.

15. A method of forming an electrical cable for use in oil and gas wells, comprising:

forming an insulated center conductor;

forming an insulated first outer conductor;

forming an insulated second outer conductor;

placing said first outer conductor adjacent said center conductor and said second outer conductor adjacent said center conductor opposite said first outer conductor, thus forming a parallel array of conductors in a flat configuration;

placing a first longitudinal spring member adjacent an outside edge of said first outer conductor and a second longitudinal spring member adjacent an outside edge of said second outer conductor;

wrapping said conductors and said spring members with an outer armor layer, such that the application of said armor layer flexes said pair of spring members thereby urging said outer conductors toward said center conductor; and flattening said armor layer against said parallel array of conductors to allow said spring members to return substantially to their original form, thereby urging said conductors together.

16. The method according to claim 15 wherein the forming of each of said conductors further comprises:

extruding a center copper conductor element;

insulating said center copper conductor element with an insulated layer; and shielding said insulated layer with a lead sheath.

17. The method of claim 16 wherein each of said conductors has a substantially octagonal exterior shape.

18. The method of claim 15 wherein the placing of the first and second longitudinal spring members further comprises providing said spring members with edges and notches along each edge.

19. The method of claim 15 wherein the placing of the first and second longitudinal spring members further comprises providing said spring members with a smaller radius than a radius of said conductors.

20. The method of claim 15 wherein the placing of the first and second longitudinal spring members further comprises providing said spring members with corrugated edges.

21. The method of claim 15 wherein the placing of the first and second longitudinal spring members further comprises providing each said spring member with a first and second edge running substantially parallel to one another and wherein each of said first and second edges touches the outside edge of each of a corresponding one of said outer conductors.

22. The method of claim 15 wherein the placing of the first and second longitudinal spring members further comprises providing each of said spring members with a substantially C-shaped configuration.

* * * * *